US006637364B1

(12) United States Patent
Campeau

(10) Patent No.: US 6,637,364 B1
(45) Date of Patent: Oct. 28, 2003

(54) FLEXIBLE COVER SUPPORT FRAME TENSIONING APPARATUS

(76) Inventor: James J. Campeau, 45524 Private Shore Dr., Chesterfield, MI (US) 48047

( * ) Notice: Subject to any disclaimer, the term of this patent is extended or adjusted under 35 U.S.C. 154(b) by 0 days.

(21) Appl. No.: 10/055,128

(22) Filed: Jan. 22, 2002

(51) Int. Cl.[7] ..... B63B 17/00
(52) U.S. Cl. ..... 114/361
(58) Field of Search ..... 114/361

(56) References Cited

U.S. PATENT DOCUMENTS

| | | | | |
|---|---|---|---|---|
| 617,571 | A | 1/1899 | Harlow | |
| 714,650 | A | 11/1902 | Truscott | |
| 1,588,128 | A | 6/1926 | Montgomery | |
| 2,829,660 | A | 4/1958 | Wester et al. | 135/6 |
| 3,051,967 | A | 9/1962 | Beach | 9/1 |
| 3,629,981 | A | * 12/1971 | McCaffery | 52/19 |
| 4,779,294 | A | 10/1988 | Miller | 5/414 |
| 4,793,371 | A | 12/1988 | O'Ferrell et al. | 135/106 |
| 5,009,184 | A | 4/1991 | Voldrich | 114/361 |
| 5,522,409 | A | 6/1996 | May | 135/88.05 |
| 5,598,668 | A | 2/1997 | Isom | 52/86 |
| 5,601,339 | A | 2/1997 | Buiani | 297/440.1 |
| 5,702,196 | A | 12/1997 | Petercsak | 403/46 |
| 5,713,686 | A | 2/1998 | Maughan | 403/46 |
| 5,743,208 | A | 4/1998 | Miller | 114/361 |
| 5,803,104 | A | 9/1998 | Pollen | 135/96 |
| 5,918,613 | A | 7/1999 | Larson | 135/88.01 |
| 6,073,642 | A | 6/2000 | Huang | 135/114 |
| 6,409,262 | B1 * | 6/2002 | LaPointe | 297/68 |

* cited by examiner

*Primary Examiner*—Stephen Avila
(74) *Attorney, Agent, or Firm*—Young & Basile, P.C.

(57) ABSTRACT

A tensioning apparatus for a flexible covering mountable to a frame structure having at least one frame member. The tensioning apparatus includes a sleeve having opposed end bores which are oppositely threaded. First and second stubs are fixedly mountable in opposed portions of the frame member with threaded ends extending axially outward into engagement with the bores in the tubular sleeve. Rotation of the tubular sleeve causes axial adjustment of the portions of the frame member relative to each other. In one aspect, a stabilizer rod is fixed to one of the first and second stubs and extensibily projects through the tubular sleeve and the other of the first and second stubs. A set screw may be optionally mounted in the tubular sleeve for fixed engagement with one of the first and second stubs to lock the tubular sleeve in a fixed position.

8 Claims, 5 Drawing Sheets

FLEXIBLE COVER SUPPORT FRAME TENSIONING APPARATUS

BACKGROUND

The present invention relates, in general, to flexible covers that are held taut by a frame formed of a plurality of tubes, one end of certain of the tubes being fixed to stationary structure.

Boat covers formed of canvas or other synthetic fabrics are mounted by a framework of pivotally interconnected tubes formed of aluminum or stainless steel. While the tubes are pivotal to allow collapsing of the entire frame to a folded down position exposing the boat passenger compartment, the frame is nevertheless is arranged for one particular upright geometry.

Side curtains are frequently mounted around the Bimini top by interconnecting the side curtains to snaps or zippers mounted on the boat, the Bimini top and/or portions of the side curtains themselves.

As with Bimini tops, it is difficult to apply the proper tension to the side curtains to keep the entire surface area of the side curtains equally tensioned in a taut state. It is also difficult, due to shrinkage of the canvas or synthetic material used to form the side curtains, to stretch the ends of the side curtains sufficiently to allow the snaps or zippers to be easily engaged.

Tensioning devices in the form of telescoping tube ends are provided with interconnecting pins and apertures allow the tube ends to telescopingly expand and retract so as to enable equalization of the tension of the Bimini top. In this manner, uniform tension can be applied to the cover to eliminate sags and wrinkles which could lead to the collection of water on the cover or possible tearing of the top.

However, tensioning devices have not be devised specifically for flexible covers, such as side curtains. Further, the tensioning devices used for Bimini tops provide only a small amount of adjustment and the tube ends must be forcibly extended to align the apertures for insertion of the connecting pin. Thus, it remains a difficult task to initially mount the side curtains on the Bimini top frame as well as to equalize tension across the entire extent of the side curtains.

Another application of a flexible covering mounted on a support frame is an awning. The support frame for an awning can take many configurations depending upon whether the frame is stationary and fixed in geometry or is pivotally attached to a support, such as a building wall, and can be pivoted between collapsed and,extended positions.

Awning support frames include a plurality of interconnected tubular members which are joined at ends by elbows. Ends of the tubular members adjacent to the support wall typically have a threaded connection to a pipe clamp or rod mount to facilitate assembly of the frame. The awning is generally provided with inner flanges having eyelets which allow ties to be used to attach the awning to the support frame members.

It is a time consuming task to attach an awning to a support frame due to the numerous ties which must be employed along the entire periphery of the awning.

Other types of support frames have been provided with tensioning means in the form of a turn buckle with opposed threaded bores which engage the threaded ends of two frame members or one frame member and a pivotal clevis mounted on a stationary support. Fine threads have been employed in such turn buckles. However, the fine threads have proven to be too small as the fine threads make rotation of the turn buckle hard to rotate thereby making adjustment of the tensioning device difficult.

Thus, it would be desirable to devise a flexible cover support frame having tensioning means which enables changes in the geometry of the frame to allow easy mounting the cover on the frame as well as to equalize tension over the entire surface area of the cover when mounted on the frame. It would also be desirable to provide a flexible cover support frame in which the tensioning means or devices may be easy applied in a retrofit application to existing support frames. It would also be desirable to provide a flexible cover support frame wherein the tensioning devices may be hand operated without the need for tools or extreme amounts of force.

SUMMARY

The present invention is a tensioning apparatus for tightening a flexible cover on a frame structure. The present invention is also a flexible cover frame structure including such a tension apparatus. The tensioning apparatus is particularly useful in tightening building awnings as well as side curtains mounted on a frame structure supporting a Bimini top on a marine vessel.

In one aspect of the invention, the tensioning apparatus includes a flexible cover frame assembly having at least one frame member. The frame member has a first end. A second frame member is axially aligned with the first frame member and has a second end. The first and second ends are oppositely threaded.

A tubular sleeve has first and second oppositely threaded bores extending inward from opposite ends. The bores are threadingly engagable with the first and second threaded ends of the frame members for axial adjustment of the first and second frame members relative to each other upon rotation of the tubular sleeve. This enables the combined length of the first and second frame members and the tubular sleeve to be increased to apply tension to one portion of the frame structure for tightening the flexible cover or side curtain mounted to the frame structure or detachment or decreased to simplify the attachment of the flexible cover to or from the frame structure. Subsequent elongation of the frame members moves the side curtains into a fully tightened, taut position without wrinkles.

In one aspect of the invention, the first and second threaded ends in the frame members are formed of stubs having one end fixedly mounted in the frame member and a second threaded end extending axially outward from the frame member.

In an alternate aspect of the invention, a stabilizer rod is fixed to one of the first and second stubs and projects axially thorough a bore in the tubular sleeve and a bore in the opposed stub. The rod remains extended through the tubular sleeve and both of the first and second stubs regardless of the amount of angular rotation of the tubular sleeve and the extended or retracted position of the frame members to add strength to the tensioning device by preventing buckling of the frame members at extending length positions. By preventing buckling, the stabilizer rod also insures that the frame members do not impede easy rotation of the tubular sleeve.

In another aspect, a fastener is threadingly mounted through the tubular sleeve into engagement with the threaded end portion of one of the first and second stubs to lock the tubular sleeve to the stub in a fixed position.

The tensioning device of the present invention provides significant advantages over previously devised flexible cover tensioning devices. First, the tensioning device is simple to rotate thereby enabling the frame structure to be collapsed or extended to simplify the attachment of the side curtains to the frame structure as well as to extend the side curtains to a fully taut condition without wrinkles.

Second, the tensioning device is easily mountable in a retrofit operation to an existing frame structure. At the same time, the present tensioning device can be easily integrated into an original equipment frame structure.

Third, the tensioning device is mountable at any of a number of different positions on the frame structure to insure that all portions of the cover can be fully tightened to a taut position as well as to simply the attachment of the cover to any portion of the frame structure. Finally, the tensioning device is easy to rotate thereby eliminating the need for tools to attach or remove the cover to and from the frame structure.

BRIEF DESCRIPTION OF THE DRAWINGS

The various features, advantages and other uses of the present invention will become more apparent by referring to the following detailed description and drawing in which.

DETAILED DESCRIPTION

Figure 1:
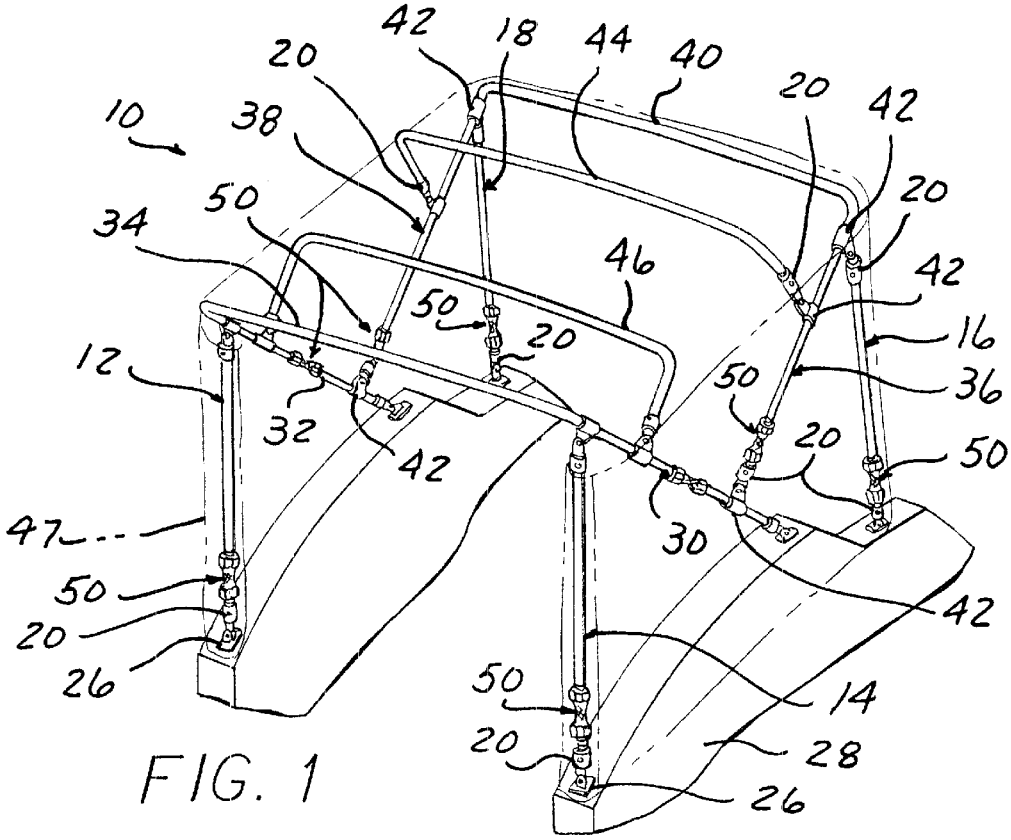
FIG. 1 is a perspective view of a tensioning apparatus according to the present invention shown mounted on a boat and supporting a Bimini top and side curtain support frame.

Refer now to the drawing, and specifically to FIGS. 1–5, there is depicted one aspect of a flexible cover support frame tensioning apparatus constructed in accordance with teachings of the present invention. The support frame 10, as is conventional, is formed of a plurality of interconnected tubes or rods of either solid or hollow construction and each tube is formed of a suitable corrosion resistant material, such as aluminum, stainless steel, engineered plastics, etc.

Although the following specific support frame 10 will be described in detail, it will be understood that the detailed construction of the support frame 10 is by way of example only as the present invention can be used with other flexible covers found on boats or support frames for other flexible panels or covers, such as awnings, as described hereafter.

By example, the support frame 10 includes a plurality of vertically extending upright tubes or rods 12, 14, 16 and 18. The four rods, 12, 14, 16 and 18 are arranged in a square or rectangular configuration and have one end mounted in a cup-shaped receiver 20, shown in detail in FIG. 5, which is pivotally connected via an aperture 22 in an arm 24 to a clevis 26 mounted on the boat structure 28.

The support frame 10 also includes a rearward angled frame assembly formed of rearward angularly extending rods 30 and 32, each having one end interconnected by a receiver 20 and a clevis 26 to the boat structure 28 and an opposite end unitarily interconnected by a cross bow 34.

A forward angled frame structure formed of forward angled rods 36 and 38 unitarily connected at one end by a front cross bow 40 is pivotally connected at such end by means of a receiver 20 and a u-shaped connector 42 to an intermediate portion of the rear frame rods 30 and 32, respectively. Intermediate cross bows 44 and 46 are pivotally connected by a similar receiver and U-shaped connector to intermediate portions of the front angular frame rods 36 and 38 and the rearward angled frame rods 30 and 32, respectively.

A Bimini top or cover, not shown, is mounted over the cross bows 34, 40, 44 and 46 and secured thereto by means of straps, snaps on the edges of the cover, zippers, etc. A side curtain 47 is mountable about the support frame 10 and secured thereto by snap on the ends of the curtains, snaps on a bottom edge which engage snaps on the boat structure and snaps or zippers on a top edge which mate with mating snaps or zipper portions along the edges of the Bimini top.

The entire support frame 10 may be pivotally collapsed to a storage position by removing the cover and the side curtains 47 and then urging the vertical rods 12, 14, 16 and 18 in a direction toward to the stern of the boat to bring the cross bows 34, 40, 44 and 46 into close alignment in much the same way as the collapsed bows of an automobile convertible top.

Figure 3:
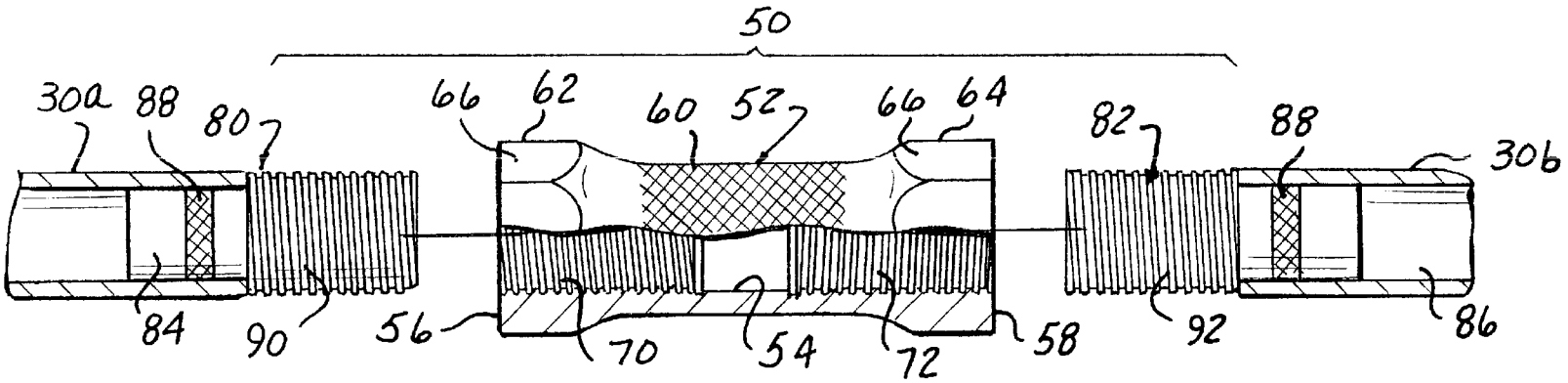
FIG. 3 is an exploded, partially cross sectioned, side elevational view of the tensioning device employed in the support frame shown in FIGS. 1 and 2.

Referring now to FIG. 3, there is depicted a tensioning device 50, usable in a number of different positions in the support frame 10 The tensioning device 50 includes a tubular sleeve 52 of generally cylindrical configuration. A bore 54 extends between a first end 56 and an opposed end and an opposed second end 58 of the sleeve 52. It will be understood that while the bore 54 is depicted as being a through bore extending completely through the sleeve 52 between the first and second ends 56 and 58, the bore 54 can also be formed of two smaller, separate bores extending inward from the first and second ends 56 and 58, respectively, with the smaller length bores terminating at inner ends.

The sleeve 50 is formed of a suitable water and corrosion resistant material, such as stainless steel, aluminum, engineered plastics, etc.

In a preferred aspect of the invention, but only depicted as an example, the sleeve 52 is formed with a generally constant diameter center portion 60 of circular cross section and two enlarged end portions 62 and 64 adjacent the first and second ends 56 and 58, respectively. Each of the first and second end portions 62 and 64 is formed with a plurality of hex flats 66.

At least a portion and, preferably, substantially all of the exterior surface of the center portion 60 of the sleeve 52 is provided with a hand grip surface, such as a textured surface formed by knurling, etc.

As shown in FIG. 3, two sets of threads are formed in the bore 54 including a right hand thread 70 extending inward from the first end 58 of the sleeve 52 and a left hand threads 72 extending inward from the opposed second end 58.

Prior turn buckles used as tensioning devices in frames have a small diameter and fine threads. Typically, such prior art turn buckle threads have approximately eight threads per inch and a small outer diameter of approximately ⅝–¾". This has impaired the rotation of the turn buckles and necessitates many rotations or turns of the turn buckle to achieve any significant adjustment in the overall length in the turn buckle and the support frame members in which the turn buckle is mounted.

Thus, according to the present invention, the threads 70 and 72 are formed as Acme threads which have a large general square cross-section of approximately 11/16" diameter. Specifically, in a preferred aspect of the present invention, the threads 70 and 72 are 1.062–8 stub Acme right hand and left hand threads, each having a major diameter of about 1.062–1.064" and a minor diameter of about 0.968".

A pair of stubs including a first stub 80 and a second stub 82 also form part of the tensioning device 50. The stubs 80 and 82 are identically formed of a first end portion 84 and 86, respectively, which is sized to securely fit within one end of the one of the tubes or rods of the support frame 10 as described hereafter. A portion or all of the exterior surface of the first end portion 84 and 86 of each stub 80 and 82 can be roughened or textured as shown by the knurled band 88 in FIG. 3.

The first end portion 84 and 86 of the stubs 80 and 82 is sized to fit within the tube ends. The opposed second end of each stub 80 and 82 is threaded with a like thread as the threads 70 and 72 in the sleeve 52. Thus, the stub 80 is formed with a left hand thread 90 and the stub 82 is formed with a right hand thread 92.

According to a preferred aspect of the present invention, the threads 90 and 92 are 1.062–8 stub Acme left hand and right hand threads, each having a major diameter of about 1.062–1.060" and a minor diameter of about 0.966–0.964".

In this manner, rotation of the sleeve 52, after the threading ends 90 and 92 of the stubs 80 and 82 have threadingly engaged the threads 70 and 72 in the bore 54 of sleeve 52 in one direction, such as clockwise when viewed from the left end in the orientation of FIG. 3, will cause the stubs 80 and 82 to move in opposed, axially outward directions from the respective first and second ends 56 and 58 of the sleeve 52 thereby increasing the overall length of the support frame tube in which the stubs 80 and 82 are mounted.

Conversely, rotating the sleeve 52 in an opposite or counterclockwise direction, when viewed from the left end of the sleeve 52, causes the threads 90 and 92 on the stubs 80 and 82 to thread into the bore 54 and the sleeve 52 thereby shortening the length of the frame tube. In this manner, a user can rotate the tensioning device 50 in either direction to increase or decrease the length of the respective frame tube or rod in which the tensioning device is mounted and thereby increase or decrease the tension on the rod and the attached portion of the side curtains 47. This enables the user to remove any wrinkles from the side curtain 47. More importantly, the use of the tensioning device 50 allows the user to initially shorten the overall length of the frame rod to enable the side curtains 47 to be attached to support frame 10 and to the boat structure 28. Then, the tensioning device 50 is rotated in an opposite direction to expand the length of the frame rod to increase the tension on the side curtains 47 to a full taut shape.

Figure 2:
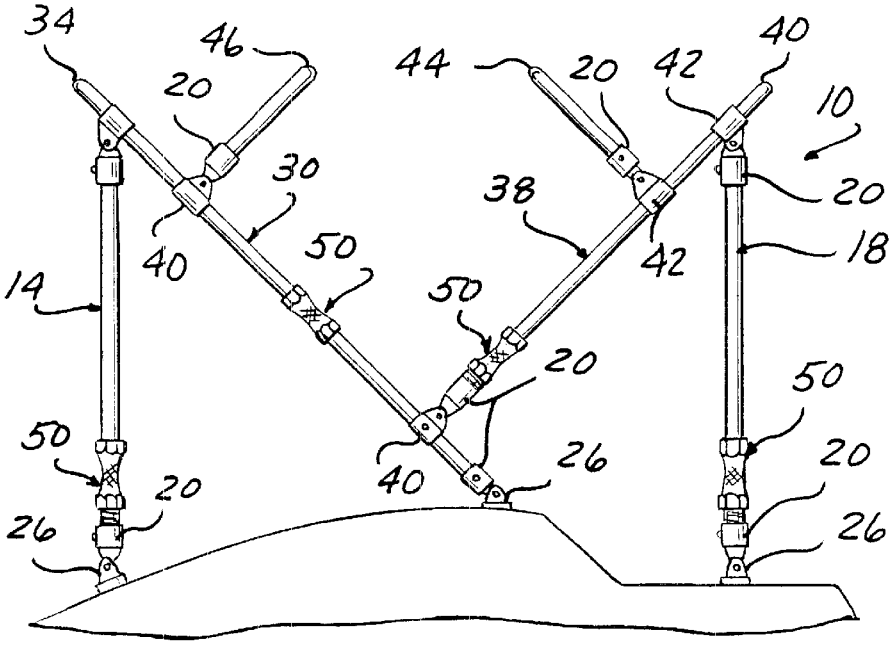
FIG. 2 is a side elevational view of the support frame shown on FIG. 1.
Figure 4:
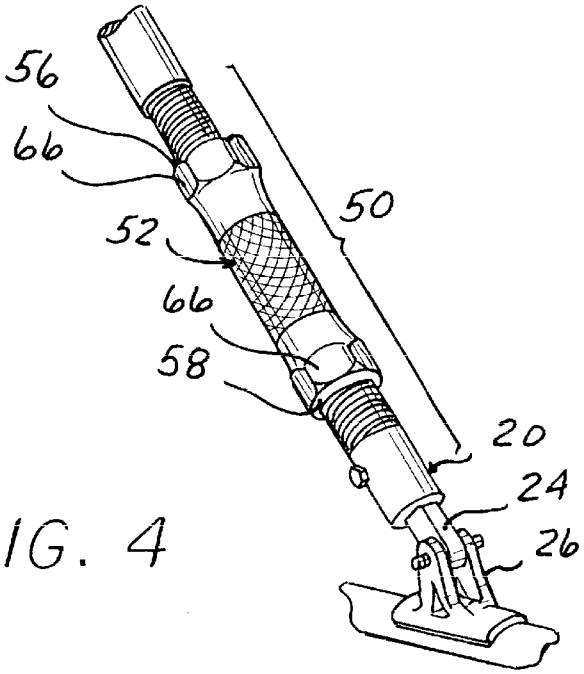
FIG. 4 is a partial, perspective view of the tensioning device shown mounted at one end of one of the tubular rods of the support frame shown in FIGS. 1 and 2.

The tensioning device 50, as shown in FIGS. 1, and 2 can be mounted at a number of different positions on the support frame 10 so as to provide the ability to uniformly tension the entire surface area of the side curtains 47 to simplify the mounting of the side curtains 47 to the support frame 10. Thus, by example only, one tensioning device 50 is mounted in each vertical rod 12, 14, 16 and 18. Additional tensioning devices 50 may also be mounted in each of the rearward angled frame rods 30 and 32 as well as the front angled frame rods 36 and 38.

The tensioning device 50 may be mounted in the frame rods in one of several different ways. In a first assembly method, which is ideal for retrofit mounting of the tensioning devices 50 on an existing boat support frame 10, one of the frame rods, such as frame rod 30 is cut at an intermediate portion between the opposed ends and a portion of a sufficient length to allow insertion of the tensioning device 50 therebetween is removed.

Next, as shown in FIG. 3, the stubs 80 and 82 are press fit into the frame rod cut portions 30*a* and 30*b*. Alternate stub mounting methods may also be employed, such as welding, set screws, etc.

Regardless of how the stubs 80 and 82 are mounted in the frame rod cut portions 30*a* and 30*b*, the threaded ends 90 and 92 extend outward from the ends of the frame rod cut portions 30*a* and 30*b* to allow the sleeve 52 to be inserted between the ends of the stubs 80 and 82 and threaded engaged with each threaded end 90 and 92 of the stubs 80 and 82.

Figure 5:
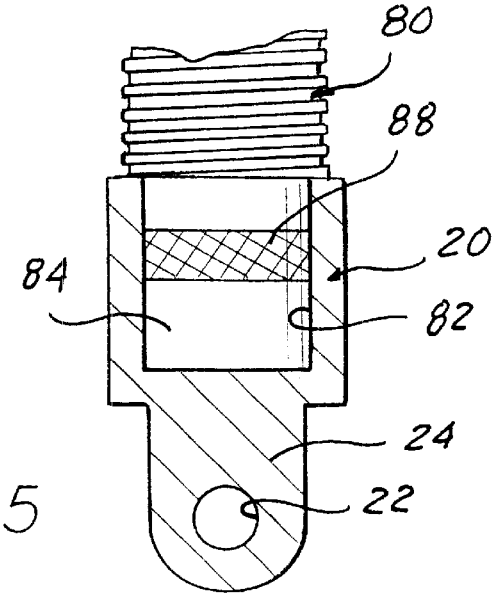
FIG. 5 is a cross sectional view showing the mounting of the tensioning device in one of the support frame tube ends.

Alternatively, as shown in FIGS. 1 and 2 and in greater detail in FIG. 5, one of the stubs, such as stub 80, is press fit into a bore 82 in the cup-shaped receiver 20 which is pivotally connected to the clevis 26 mounted on the boat structure 28 shown in FIG. 1. Again, a roughened exterior band or surface 88, shown illustrated as a knurled band in FIG. 5, by way of example only, may be used to retain the end portion 84 of the stub 80 in the receiver 20. The other stub 82, is mounted in a cut end portion of one of the frame rods, such as the frame rod 12, as shown in FIG. 1, to allow insertion of the sleeve 52 therebetween in the same manner as described above.

Figure 7:
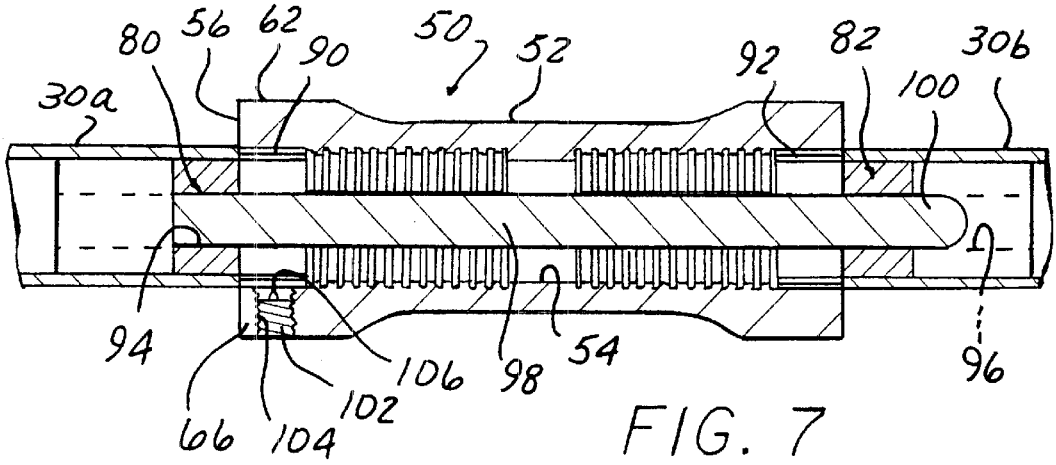
FIG. 7 is a longitudinal cross sectional view of the alternate aspect of the invention depicted in FIG. 6 and mounted in the tensioning device shown in FIG. 3.
Figure 6:
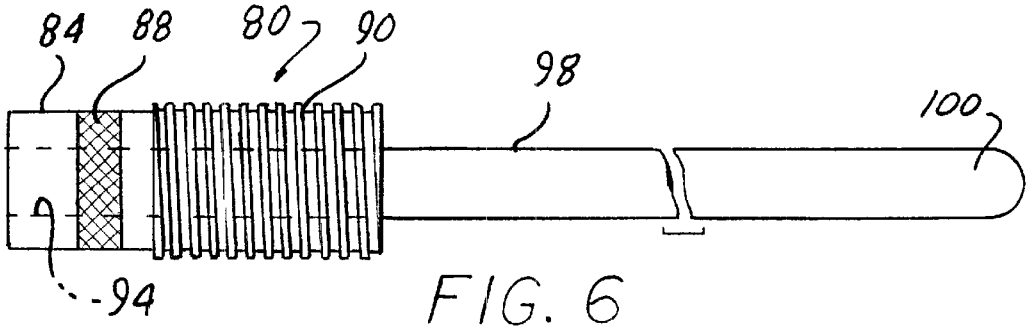
FIG. 6 is a side elevational view of another aspect of the support frame of the present invention.

Referring now to FIGS. 6 and 7, there is depicted an alternate aspect of the present invention which utilizes the same tensioning device 50 as described above which includes the stubs 80 and 82 mounted in frame rod cut portions 30*a* and 30*b* and for the receiver 20.

In this aspect, each stub 80 and 82 is formed with a through bore 94, 96, respectively, which preferably extends completely through each stub 80 and 82, or at least through the threaded end portion, 90 and 92, respectively. A stabilizing bar or rod 98 is fixedly mounted in one of the stubs, such as stub 80, by means of welding, a press fit, set screw, etc. The other end 100 of the rod 98 is extensively and retractably movable through the bore 96 in the opposite stub 82. In this manner, as shown in FIG. 7, when the tensioning device 50 is mounted between the cut frame rod portions 30A and 30B, the end 100 of the rod 98 extends completely through the sleeve 52 and slidably engages the bore 96 in the stub 82. Regardless of which direction the sleeve 52 is rotated. A substantial portion of the rod 98 will remain in each of the stubs 80 and 82. The rod 98 also remains extended between the cut portions 30A and 30B of the frame rod thereby preventing the frame rod from bending at an extended length position.

FIG. 7 also depicts another aspect of the present invention which is usable with the aspect shown in FIG. 6 or any of the other aspects of the tensioning device 50. As shown in FIG. 7, a threaded bore 104 is formed in one end of the sleeve 52, such as the enlarged end 62. The bore 104 extends completely through the side wall of the sleeve 52 and opens to the internal bore 54 extending through the sleeve 52 or at least the end bore extending from the first end 56 of the sleeve 52. The set screw 102 is threadingly insertable to the bore 104 and has a tip 106 preferably formed of a resilient material, such as nylon, which is adapted to engage the thread 90 on the stub 80 to fixably lock the position of the sleeve 52 relative to the stub 80 and, indirectly, the opposed stub 82.

It should also be noted that in place of the stubs or plugs 80 and 82, it is included within the scope of the present invention that the respective frame rods of the support frame 10 may be originally formed into portions or sections having opposed ends faced apart a sufficient distance to allow insertion of the tensioning device 50 therebetween, as described above. The opposed ends of each frame rod portion can be formed with axially outward extending threaded ends, similar to the threaded ends 90 and 92 described above. As described in the present invention, the threaded ends 90 and 92 will be oppositely threaded in right hand and lefthand threads.

Figure 8:
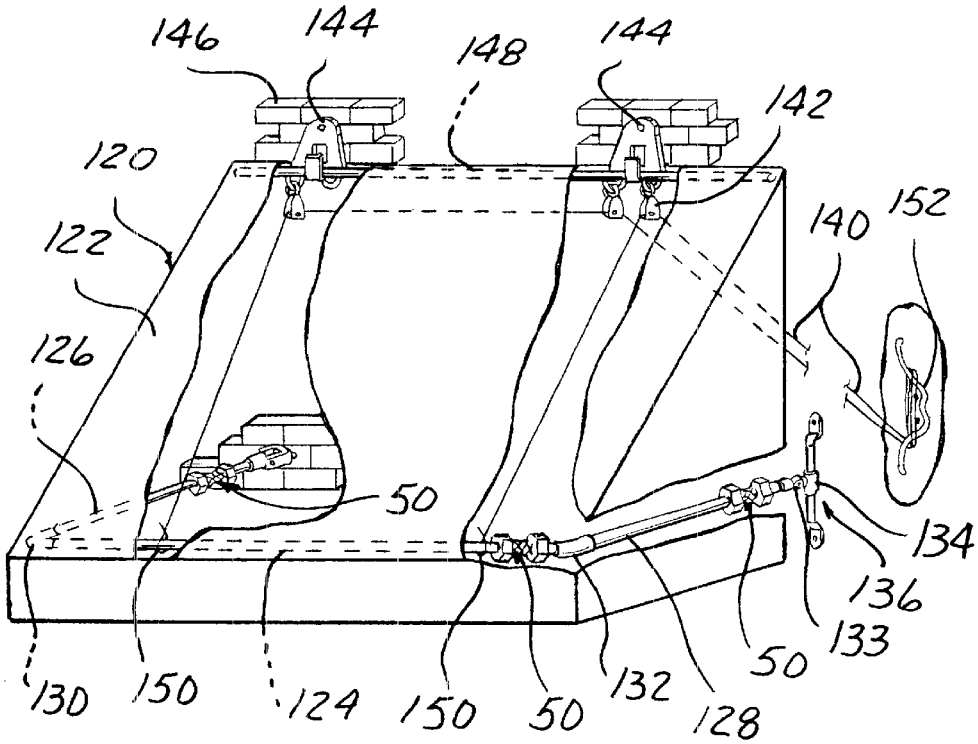
FIG. 8 is a perspective view showing the mounting of the tensioning apparatus in one aspect of the present invention on a pivotal awning support frame.
Figure 9:
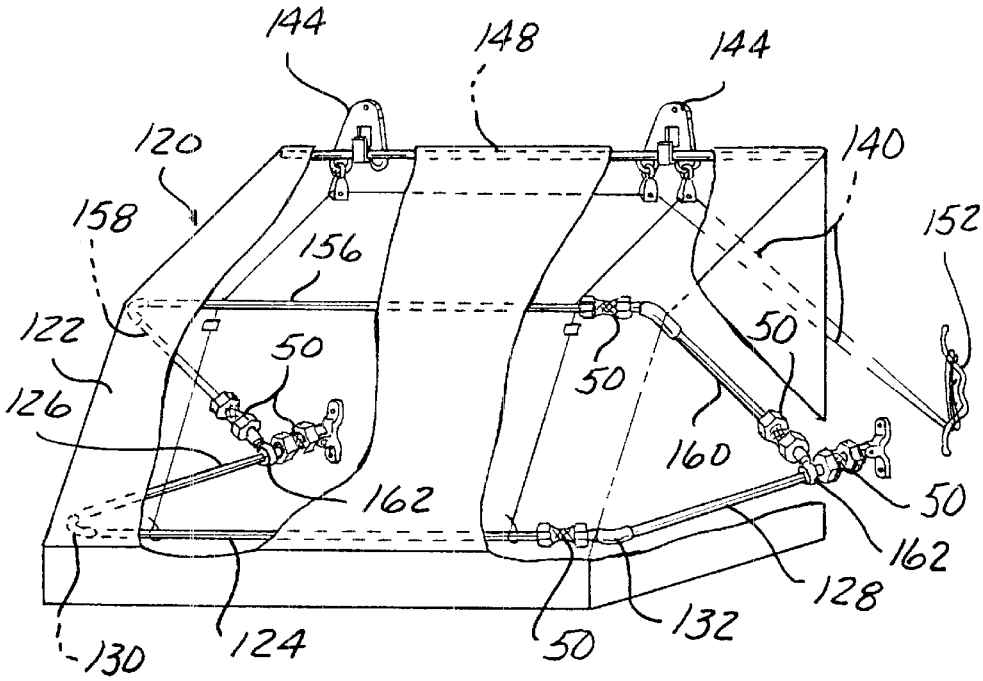
FIG. 9 is a perspective view showing the tensioning device of the present invention mounted in another aspect of a pivotal awning support frame.
Figure 10:
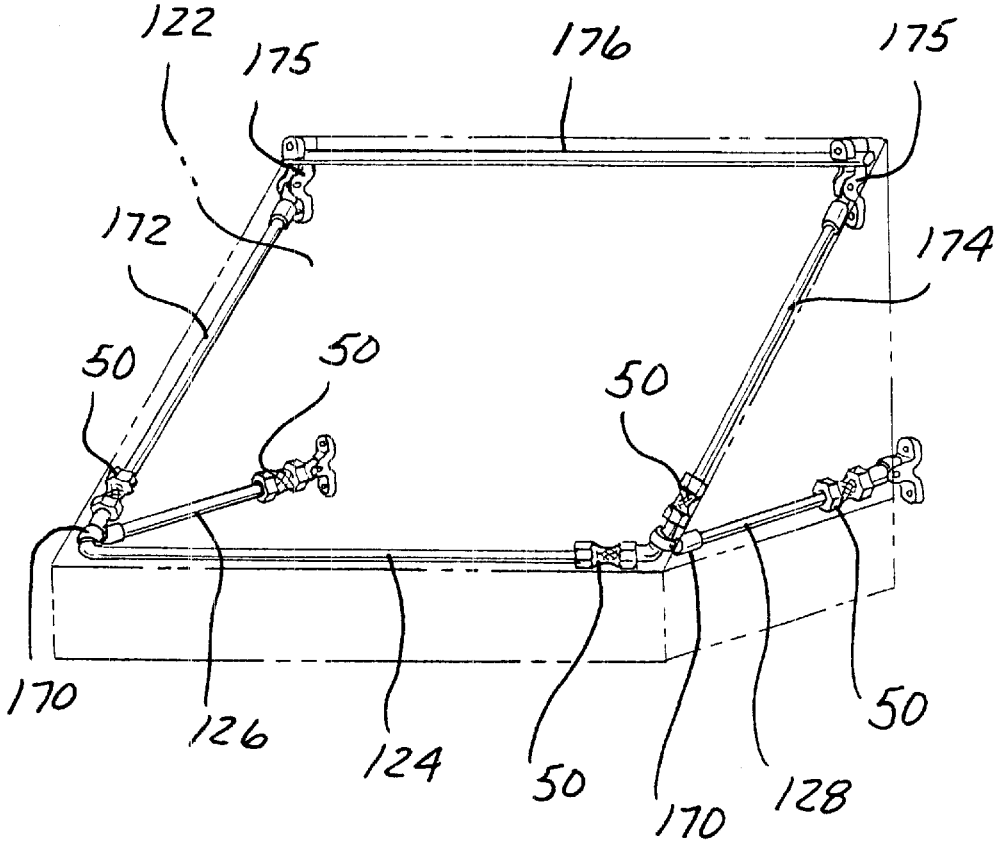
FIG. 10 is a perspective view showing the mounting of the tensioning device of the present invention in a stationary awning support frame.

Referring now to FIGS. 8–10, there is depicted other types of support frames having the tensioning device of the present invention mounted therein to provide easy mounting and removal as well as tightening of the flexible covers to a taut shape on the support frames. All of the applications shown in FIGS. 8–10 are for different flexible awnings mounted on stationary or pivotal support frames.

Referring now to FIG. 8, and by way of background only, the awning 120 includes a flexible awning cover 122 having the illustrated shape, by way of example only. A support frame is mounted interiorly of the cover 122 and includes a tubular crossbar 124 and two tubular side members 126 and 128. The crossbar 124 is rigidly connected to the side members 126 and 128 by elbows 130 and 132.

The opposed ends of the side members 126 and 128 are press fit or threaded into a sleeve 132 which is pivotally connected by a ball or hinge joint 134 to a wall mount structure 136 which is fixedly mounted on a building or house wall Although the crossbar 124 is rigidly connected to the side members 126 and 128, the entire support frame is pivotal from the deployed or extended position shown in FIG. 8 to a collapsed position wherein the crossbar 124 is disposed adjacent the building wall and the upper portion of the awning cover 122.

By way of example only, and not included as part of the invention, a deployment mechanism formed of ropes or cords 140, which extend through pulleys 142 extending from clamps 144 which are fixedly mounted on the building wall 146 and support an awning head rod 148, extend to opposite ends 150 tied or otherwise secured to the crossbar 124. Movement of the ropes 140 will allow the awning 120 to move from the extended position shown in FIG. 8 to a collapsed position adjacent the building wall 146. The ropes 140 may be secured to a cleat 152 mounted on the building wall 146 to hold the awning 120 in the collapsed position. The cleat 152 may also serve to receive the end portions of the ropes 140 when the awning is in the deployed or extended position shown in FIG. 8.

The support frame of the awning 120 is provided with one or more tensioning devices 50 as described above and shown in FIGS. 1–7. Thus, by way of example only, one tensioning device 50 is mounted in each of the side members 126 and 128 as well as in the crossbar 124. The tensioning devices 50 thus allow selected extension and retraction of the side members 126 and 128 and the crossbar 124 to facilitate the attachment or removal of the awning cover 122 from the awning support frame. It will be understood that each of the tensioning devices 50 may optionally include the set screw 104 described above and shown in FIG. 7 as well as the stabilizing rod 98 extending through the tensioning device 50 into one of the side members 126 and 128 or the crossbar 124.

A modified awning support frame is shown in FIG. 9. The support frame shown in FIG. 9 is similar to the support frame shown in FIG. 8 in that it includes the crossbar 124 rigidly connected to the side members 126 and 128. The awning 120 is also provided with the ropes 140 to facilitate raising and lowering of the awning 120.

However, the awning support frame shown in FIG. 9 includes an additional center support frame formed of a center crossbar 156 and two center side members 158 and 160. The center support frame provides a break in the front panel of the awning cover 122 at the location of the center crossbar 156.

The center crossbar 156 is rigidly connected to the center side members 158 and 160 by elbows, for example. The opposite ends of the center side members 158 and 160 are each pivotally connected by a pipe clamp 162 to the side members 126 and 128, respectively of the main support frame. At least the center crossbar 156 is attached to the inside surface of the awning cover 122 by ties etc., not shown. The center support frame formed of the center crossbar 156 and the side members 158 and 160 pivots about the pipe clamps 162 during raising and lowering movements of the main support frame as described above for the support frame shown in FIG. 8.

The center support frame shown in FIG. 9 may also be provided with tensioning means 50 in at least one and preferably all of the center crossbar 156 and each of the center side members 158 and 160 as shown in FIG. 9. This facilitates tensioning and untensioning of the center support frame during attachment, removal and even during use of the awning 120 to maintain the central portion of the awning cover 122 taut.

Refer now to FIG. 10, there is depicted yet another example of an awning support frame which similarly includes the crossbar 124 and side members 126 and 128. However, in this support frame, one end of the side members 126 and 128 is fixedly connected by pipe coupling 170 to one end of the crossbar 124 adjacent upper side extensions or side members 172 and 174 which extend from opposite ends of the crossbar 124 to a pivotal connection at the awning support structure or to mounting clamps 174 which support opposite ends of an awning head rod 176 on a building wall.

Tensioning devices 50 may be mounted in each of the support frame members including the crossbar 124, the side members 126 and 128 as well as the angled upper side members 172 and 174 to allow extension and retraction of each frame member during attachment and removal of the awning cover 122 to and from the support frame. The tensioning devices 50 also allow for adjustment in any portion of the support frame to remove wrinkles and to maintain all portions of the awning cover 122 taut so as to prevent sags during use.

In summary, there has been disclosed a unique tensioning device usable with flexible cover support frames which enables flexible covers mountable on the support frames to be easily tensioned to a taut shape without wrinkles. The tensioning device of the present invention enables the support frame members to be temporarily shortened in length to simplify the attachment of the flexible covers to fasteners on surrounding structure. Each tensioning device may then be rotated to extend the frame members to tension the flexible cover. The tensioning device of the present invention is mountable in many different flexible cover support frames, either as an original part of the support frames or in a retrofit application.

What is claimed is:

1. A tensioning apparatus for tightening a flexible cover about a cover support frame, including at least one frame member, the tensioning apparatus comprising:

first and second oppositely threaded extensions adapted to be mounted in and project from one of the opposite, spaced ends of the first and second portions of the frame member, and an end of the frame members and an attachment mountable on stationary structure, a tubular sleeve having oppositely threaded first and second end bores, the first and second end bores threadingly engaging one of the first and second threaded extensions and the attachment for axial adjustment for the length between the ends of the first and second extensions upon rotation of the tubular sleeve;

a stabilizer rod fixed to and extending from one of the first and second ends of the extensions and from one of the ends of the one extension and the attachment;

a bore formed through the tubular sleeve and the other one of the extensions and the attachment; and the rod being extensible through the tubular sleeve and the other one of the first and second ends of the frame member and the attachment and the extensions as the one of first and second frame members and the frame member and the attachment move relative toward each other upon rotation of the tubular sleeve.

2. The tensioning apparatus of claim 1 the threads in the first and second extensions and the threads in the first and second end bores being Acme threads.

3. The tensioning apparatus of claim 1 wherein the first and second threaded extensions comprise:

first and second stubs, each having first and second ends, the first end adapted to be fixed in one of the first and second portions of the frame member, the second end carrying the threads.

4. The tensioning apparatus of claim 1 further comprising:

the Acme threads on the first and second extensions and in the first and second end bores having a major diameter of approximately 1.0".

5. A tensioning apparatus for tightening a flexible cover about a cover support frame including at least one frame member, the tensioning apparatus comprising:

first and second oppositely threaded extensions adapted to be mounted in and project from opposite, spaced ends of first and second portions of the at least one frame member, respectively;

a tubular sleeve having oppositely threaded first and second end bores the first and second end bores threadingly engaging the first and second threaded extensions for axial adjustment for the length between the ends of the first and second extensions upon rotation of the tubular sleeve;

the threads in the first and second extensions and the threads in the first and second end bores being Acme threads;

a stabilizer rod fixed to and extending from one of the first and second ends of the extensions;

a bore formed through the tubular sleeve and the other of the extensions;

the rod being extensible through the tubular sleeve and the other of the first and second ends of the frame member and the extensions as the first and second frame members move relative toward each other upon rotation of the tubular sleeve; and a fastener threadingly extensible through the tubular sleeve into engagement with one of the first and second ends of the first and second extensions to rotationally lock the tubular sleeve to one of the first and second ends of the extensions.

6. A tensioning apparatus for tightening a flexible cover about a cover support frame including at least one frame member the tensioning apparatus comprising:

first and second oppositely threaded extensions adapted to be mounted in and project from opposite, spaced ends of first and second portions of the at least one frame member, respectively;

a tubular sleeve having oppositely threaded first and second end bores, the first and second end bores threadingly engaging the first and second threaded extensions for axial adjustment for the length between the ends of the first and second extensions upon rotation of the tubular sleeve;

the threads in the first and second extensions and the threads in the first and second end bores being Acme threads; and a fastener threadingly extensible through the tubular sleeve into engagement with one of the first and second ends of the first and second extensions to rotationally lock the tubular sleeve to one of the first and second ends of the extensions.

7. A tensionable side curtain support apparatus for a boat side curtain comprising:

a support frame formed of a plurality of interconnected frame members, certain of the frame members being attachable to boat structure;

tensioning apparatus mounted in at least certain of the frame members between one of opposed separate portions of one frame member and an end of the one frame member, and an attachment mountable on a boat, the tensioning apparatus including:

first and second oppositely threaded extensions projecting from the first and second separate.frame member portions and the attachment, respectively; and a tubular sleeve having oppositely threaded first and second end bores, the first and second end bores threadingly engaging one of the first and second threaded extensions and the attachment for axial adjustment for the length of the frame member upon rotation of the tubular sleeve, the threads in the extensions and the first and second end bores being Acme threads; and a fastener threadingly extensible through the tubular sleeve into engagement with one of the first and second ends of the first and second extensions to rotationally lock the tubular sleeve to one of the first and second ends of the extensions.

8. The tensioning apparatus of claim 7 further comprising:

a stabilizer rod fixed to and extending from one of the first and second ends of the extensions;

a bore formed through the tubular sleeve and the other of the extensions;

the rod being extensible through the tubular sleeve and the other of the first and second ends of the frame member and the extensions as the first and second frame members move relative toward each other upon rotation of the tubular sleeve.

* * * * *